US007538785B2

(12) United States Patent
Yamamoto et al.

(10) Patent No.: US 7,538,785 B2
(45) Date of Patent: May 26, 2009

(54) THERMAL PRINT HEAD AND METHOD FOR MANUFACTURING THE SAME

(75) Inventors: Masaya Yamamoto, Kyoto (JP); Shinobu Obata, Kyoto (JP)

(73) Assignee: Rohm Co., Ltd., Kyoto (JP)

( * ) Notice: Subject to any disclaimer, the term of this patent is extended or adjusted under 35 U.S.C. 154(b) by 50 days.

(21) Appl. No.: 11/597,491

(22) PCT Filed: May 23, 2005

(86) PCT No.: PCT/JP2005/009347

§ 371 (c)(1),
(2), (4) Date: Nov. 22, 2006

(87) PCT Pub. No.: WO2005/120841

PCT Pub. Date: Dec. 22, 2005

(65) Prior Publication Data

US 2007/0229645 A1 Oct. 4, 2007

(30) Foreign Application Priority Data

May 25, 2004 (JP) ..... 2004-154489

(51) Int. Cl.
*B41J 2/335* (2006.01)

(52) U.S. Cl. ..... 347/202

(58) Field of Classification Search ..... 347/202, 347/203, 204, 206, 208
See application file for complete search history.

(56) References Cited

FOREIGN PATENT DOCUMENTS

| | | |
|---|---|---|
| JP | 62-46657 | 2/1987 |
| JP | 6-296071 | 10/1994 |
| JP | 10-264429 | 10/1998 |
| JP | 11-138880 | 5/1999 |
| JP | 2001-246770 | 9/2001 |

OTHER PUBLICATIONS

International Search Report for corresponding PCT application PCT/JP2005/009347, mailed Nov. 8, 2005.

*Primary Examiner*—K. Feggins
(74) *Attorney, Agent, or Firm*—Hamre, Schumann, Mueller & Larson, P.C.

(57) ABSTRACT

A thermal printhead (A1) includes electrodes (3*a*-3*c*) embedded in a glaze layer 2 at least at a portion laminated with a resistor (4). Favorably, the portion of the electrodes (3*a*-3*c*) laminated with the resistor (4) is sunk to a depth causing the surfaces of the electrodes to be flush with the surface of the glaze layer 2. Such structure enhances the heat transfer efficiency from a heating portion (40) of the resistor (4) to a thermal recording medium, and smooth transfer of thermal recording paper.

16 Claims, 17 Drawing Sheets

THERMAL PRINT HEAD AND METHOD FOR MANUFACTURING THE SAME

TECHNICAL FIELD

The present invention relates to a thermal printhead and method for manufacturing the same.

BACKGROUND ART

FIGS. 30 and 31 illustrate conventional thermal printheads. The thermal printhead X1 includes an insulating substrate 90, a glaze layer 91, a resistor 92, electrodes 93*a*, 93*b*, and a protection layer 94 laminated in the mentioned order (see Patent Document 1, for example). The resistor 92 includes a heating portion 92*a* arranged between the electrodes 93*a*, 93*b*. The heating portion 92*a* generates heat which enables printing on a thermal recording medium.

In manufacturing the thermal printhead X1, the electrodes 93*a*, 93*b* are formed after the formation of the resistor 92. Formation of the electrodes 93*a*, 93*b* is performed by printing and then baking resinate gold paste on the resistor 92. Due to the heat for the baking, the resistor 92 may be oxidized into alteration.

To solve this problem, the resistor 92 and the electrodes 93*a*, 93*b* of the thermal printhead X2 shown in FIG. 31 are laminated to each other in an order different from the thermal printhead X1 shown in FIG. 30. With such arrangement, when forming the electrodes 93*a*, 93*b*, the resistor 92 is not yet formed. Thus, the resistor 92 is prevented from being oxidized due to the baking step of the electrodes 93*a*, 93*b*.

However, the thermal printhead X2 shown in FIG. 31 still has room for improvement as described below.

First, the electrodes 93*a*, 93*b* provide a surface level difference H relative to the glaze layer 91, by the thickness of the electrodes 93*a*, 93*b*. The resistor 92 is bent through a sharp angle at the portions with the surface level difference H. It is difficult to properly form the resistor 92 with a bend at a sharp angle. Further, the resistor 92 is likely to be disconnected at the bent portions.

Second, the heating portion 92*a* of the resistor 92 is arranged at a low portion between the electrodes 93*a*, 93*b*. Thus, when a thermal recording medium is arranged on the protection layer for printing, a distance between the thermal recording medium and the heating portion 92*a* is relatively large. This lowers the heat transfer efficiency from the resistor 92*a* to the thermal recording medium. As a result, the print density is lowered and thus poses difficulty in the high-quality printing as well as the high-speed printing.

Third, the surface of the protection layer 94 has irregularities because of the arrangement of the electrodes 93*a*, 93*b* and the resistor 92. In the irregularities, there is a tendency of accumulation of ink of an ink ribbon for thermal recording or of paper particles of thermal paper. Further, transfer of the thermal recoding medium cannot be performed smoothly in contact with the surface of the protection layer 94.

DISCLOSURE OF THE INVENTION

Problem to be Solved

The present invention is proposed under the above-described circumstances. It is therefore an object of the present invention to provide a thermal printhead and method for manufacturing the same, for preventing disconnection of the resistor, for enhancing heat transfer efficiency from the heating portion of the resistor to the thermal recording medium, and for smooth transfer of the thermal paper.

Means for Solving the Problem

A first aspect of the present invention provides a thermal printhead comprising a substrate; a glaze layer formed on the substrate; a plurality of electrodes formed on the glaze layer, the electrodes being spaced from each other; and resistors laminated on the electrodes and the glaze layer, bridging the electrodes. The electrodes are embedded in the glaze layer at least at portions laminated with the resistor.

Favorably, the electrodes are embedded to a depth causing the surfaces of the electrodes to be flush with the surface of the glaze layer at portions laminated with the resistors.

Favorably, the thermal printhead further comprises a protection layer for covering the electrodes and the resistors.

Favorably, each of the electrodes has a melting point higher than softening point of the glaze layer, and is made of a metal having a specific gravity higher than the glaze layer.

Favorably, the resistors have a width smaller than a width of the electrode at portions overlapping with the resistors.

Favorably, each of the resistor is formed into a strip extending in primary scanning direction. The electrodes include a plurality of individual electrodes and at least one common electrode. The common electrode includes at least one belt-like portion spaced from the resistor in secondary scanning direction and extending in the primary scanning direction, and also includes a plurality of narrow portions extending from the belt-like portion in the secondary scanning direction across the resistor and being aligned in the secondary scanning direction. Each of the individual electrodes includes a narrow portion extending in the secondary scanning direction across the resistor, and is aligned in the primary direction alternately with the narrow portions of the common electrode.

Favorably, the common electrode includes a pair of belt-like portions spaced from each other in the secondary scanning direction across the resistor.

Favorably, at least one of the narrow portions of the common electrode connect the pair of belt-like portions to each other.

Favorably, each of the electrodes is formed with a bonding pad for wire bonding. The bonding pad protrudes out of the glaze layer.

Favorably, the bonding pad protrudes out of the glaze layer by 1 μm.

Favorably, a portion of the electrodes formed with the bonding pad has a thickness larger than other portion of the electrode without the bonding pad.

Favorably, the bonding pad includes a first portion flush with the glaze layer, and a second portion formed on the first portion.

A second aspect of the present invention provides a method of manufacturing a thermal printhead, comprising the steps of forming a plurality of electrodes spaced from each other on a glaze layer formed on a substrate; and forming a resistor on the glaze layer and the electrodes, the resistor being arranged to bridge the electrodes. The method further comprises a step for embedding the electrodes, performed after forming the electrodes and before forming the resistor, in which at least a portion of the glaze layer is softened by heating, so that at least a portion of each of the electrodes is caused to sink into the glaze layer.

Favorably, the step for forming the resistor is performed by forming a resistive film and then by performing dry etching at the film. Here, the dry etching includes etching by physical energy of ionized gas, and etching by physical energy and chemical action of ionized and activated reactive gas, such as sputter etching, ion beam etching (ion beam sputtering), plasma ashing, plasma etching, and RIE (reactive ion etching).

Favorably, the manufacturing method of thermal printhead further comprises a step, performed before the step for embedding the electrodes, for forming a second portion on a part of each of the electrodes.

Favorably, the manufacturing method of thermal printhead further comprises a step, performed after the step for embedding the electrodes, for forming a second portion at least partly laminated on a part of each of the electrodes.

Other advantages and features will be apparent from the following description of the embodiments.

BEST MODE FOR CARRYING OUT THE INVENTION

A preferred embodiment of the present invention is specifically described below with reference to the accompanying drawings.

Figure 1:
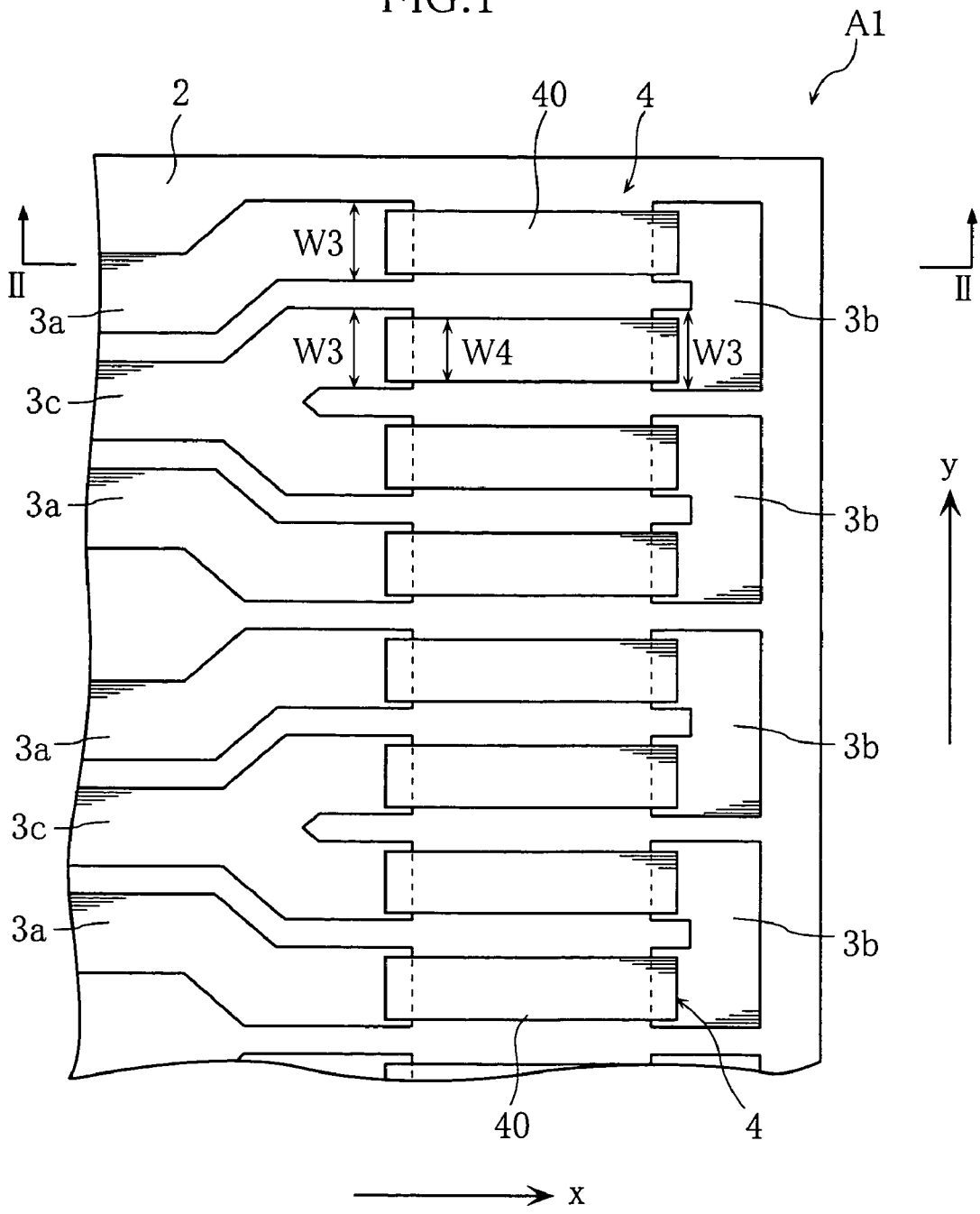
FIG. 1 is a plan view illustrating the principal portions of a thermal printhead according to a first embodiment of the present invention.
Figure 2:
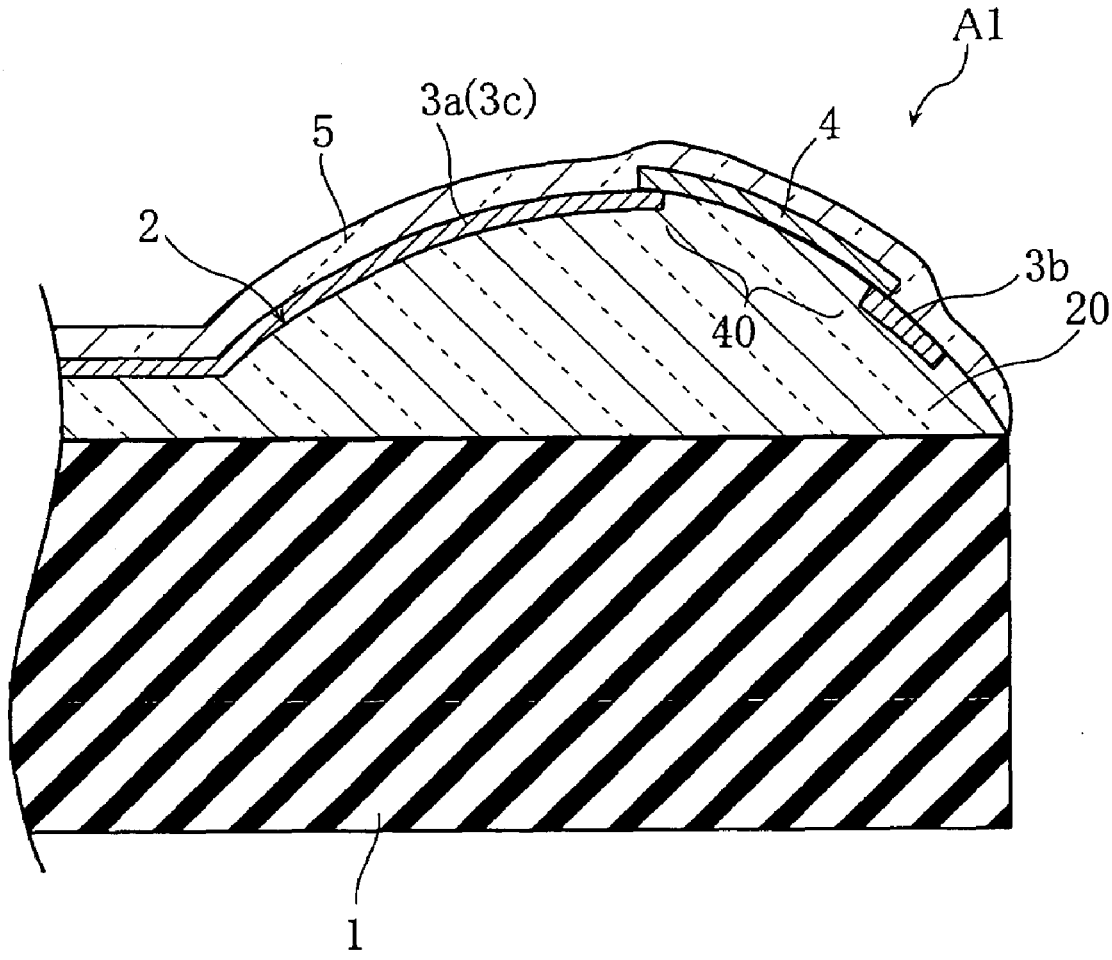
FIG. 2 is a sectional view taken along the lines II-II of FIG. 1.

FIGS. 1 and 2 illustrate a first embodiment of a thermal printhead according to the present invention. The thermal printhead A1 of the embodiment includes a substrate 1, glaze layer 2, a plurality of electrodes 3*a*-3*c*, a plurality of resistors 4, and a protection layer 5. In FIG. 1, the protection layer 5 is omitted.

The substrate 1 is a flat rectangular insulating substrate made of ceramic, and extends in the primary scanning direction y. The glaze layer 2 is formed on the substrate 1 by printing and baking an amorphous glass paste, and serves to enhance the heat reservation and to smooth the surface which is to be formed with the plurality of electrodes 3*a*-3*c*. The glaze layer 2 has a projection 20 having a convex surface. The projection 20 serves to increase the contact pressure between portions of the protection layer 5, corresponding in position to heating portions 40 described below, and a thermal recording medium such as ink ribbon and thermal paper.

The electrodes 3*a*-3*c* are formed on the glaze layer 2 by printing and baking gold resinate paste, for example. As shown in FIG. 2, each of the electrodes 3*b* is formed in a U-shape with two ends, on the projection 20 of the glaze layer 2, in the vicinity of one side end of the substrate 1.

As shown in FIG. 1, each of the electrodes 3*a*, 3*c* extends in the secondary scanning direction x. One end of the electrode 3*a* faces and spaced from one end of a respective one of the electrodes 3*b*. The other end of the electrode 3*a* is connected to a respective one of drive ICs (not shown) for power control. One end of the electrode 3*c* diverges into two legs, each facing and being spaced from the other end of a respective one of the electrode 3*b*. The other end of the electrode 3*c* is connected to a common line (not shown). When the drive ICs are switched on, an electrical current flows from the common line to the resistor 4 and the electrodes 3*b*, 3*a*, via the electrode 3*c*.

As shown in FIG. 2, the electrodes 3*a*-3*c* are embedded in the glaze layer 2. Thus, the surface of the electrodes 3*a*-3*c* is substantially flush with the surface of the glaze layer 2. In other words, a difference in level between the surfaces of the electrodes 3*a*-3*c* and the surface of the glaze layer 2 is completely or almost eliminated.

The resistors 4 are laminated on the glaze layer 2 and the electrodes 3*a*-3*c*, and aligned in the primary scanning direction y, in a manner such that each of the resistor bridges between an end of a respective one of the electrodes 3*b* and an end of a respective one of the electrodes 3*a*, 3*c*. The resistor 4 is made of $TaSiO_2$, for example. The width W4 of the resistor 4 is smaller than the width W3 of the electrodes 3*a*-3*c* at portions overlapping with the resistor 4. In the present embodiment, the width W3 is about 25 μm, while the width W4 is 23 μm.

The protection layer 5 is formed to cover the glaze layer 2, the electrodes 3*a*-3*c*, and the resistors 4. The protection layer 5 is formed by printing and baking glass paste, for example, similarly to the glaze layer 2. The protection layer 5 serves to prevent the electrodes 3*a*-3*c* and the resistors 4 from directly contacting the thermal recording medium, and from being corroded chemically or electrically. The protection layer 5 also serves to enhance the surface smoothness. The smoothed surface reduces friction caused in printing between the protection layer 5 and the thermal recording medium, thereby facilitating the performance of printing.

Next, the function of the thermal printhead A1 is described below.

Figure 30:
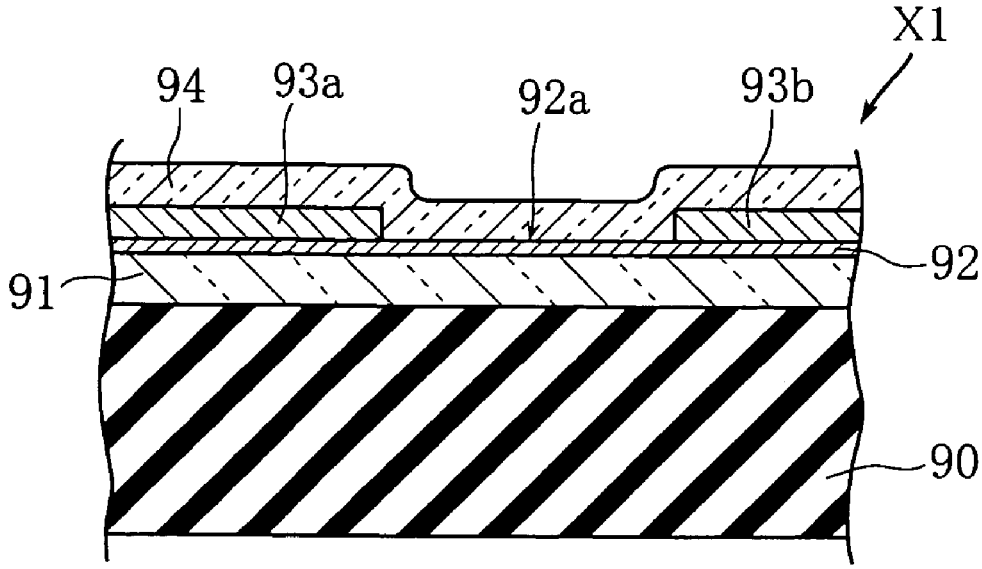
FIG. 30 is a sectional view illustrating an example of a conventional thermal printhead.
Figure 31:
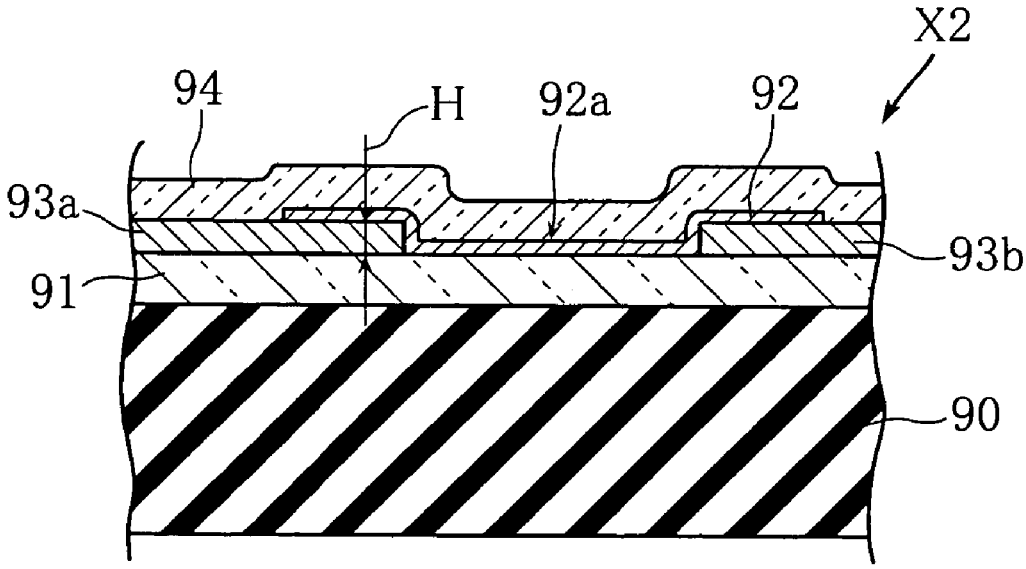
FIG. 31 is a sectional view illustrating another example of a conventional thermal printhead.

In the thermal printhead A1 of the present embodiment, a difference in level between the surface of the glaze layer 2 and the surface of the electrodes 3*a*-3*c* is completely or almost eliminated. Thus, each of the resistors 4 is formed without any sharply angled portion, so that disconnection may not occur in the resistor 4. Further, as the heating portion 40 of the resistor 4 is not embedded deep between the electrodes 3*a*, 3*c* and the electrodes 3*b*, the distance between the heating portion 40 and the thermal recording medium is smaller than that of the conventional thermal printheads X1, X2 shown in FIGS. 30 and 31. The arrangement improves the heat transfer efficiency between the heating portion 40 and the thermal recording medium, thereby increasing the print density. As a result, high-quality printing and high-speed printing are achieved. Still further, a difference in level on the surface of the protection layer 5 covering the glaze layer 2 and the electrodes 3*a*-3*c* is reduced. This prevents accumulation of ink of an ink ribbon, for example, in irregularities on the surface of the protection layer 5. It also enables thermal paper as the thermal recording medium to be smoothly transferred while contacting the surface of the protection layer 5.

In manufacturing the thermal printhead A1, the resistors 4 and the electrodes 3*a*-3*c* may be formed to deviate widthwise from proper positions. If, differing from the present embodiment, the resistors 4 and the electrodes 3*a*-3*c* have the same width, overlapping area of each of the resistors 4 and the electrodes 3*a*-3*c* is reduced by the size of the deviation. In this case, areas of the resistors 4 heated by electrical current may be irregular in size, and thus printing dots may have variation in size. However, in the present embodiment, the width W4 of the resistors 4 is smaller than the width W3 of the electrodes 3*a*-3*c* at portions overlapping with the resistors 4. Thus, even if the resistors 4 and the electrodes 3*a*-3*c* are formed to deviate widthwise from the proper positions, the resistors 4 can be prevented from unduly protruding out of the electrodes 3*a*-3*c*. In this way, the areas of the resistors 4 overlapping with the electrodes 3*a*-3*c* can be a predetermined size, and thus the printing dots can be prevented from having variation in size.

Next, an example of manufacturing method of the thermal printhead A1 is described with reference to FIGS. 3-11. FIGS. 3-11 are plan views and sectional views illustrating a series of steps in the manufacturing method of the thermal printhead A1 according to the present embodiment.

Figure 3:
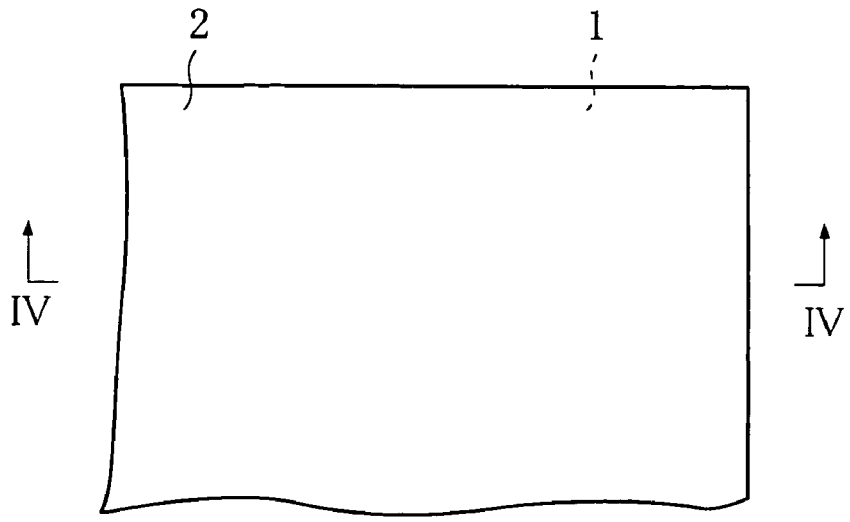
FIG. 3 is a plan view illustrating a step for forming a glaze layer in an example of manufacturing method of the thermal printhead shown in FIGS. 1 and 2.
Figure 4:
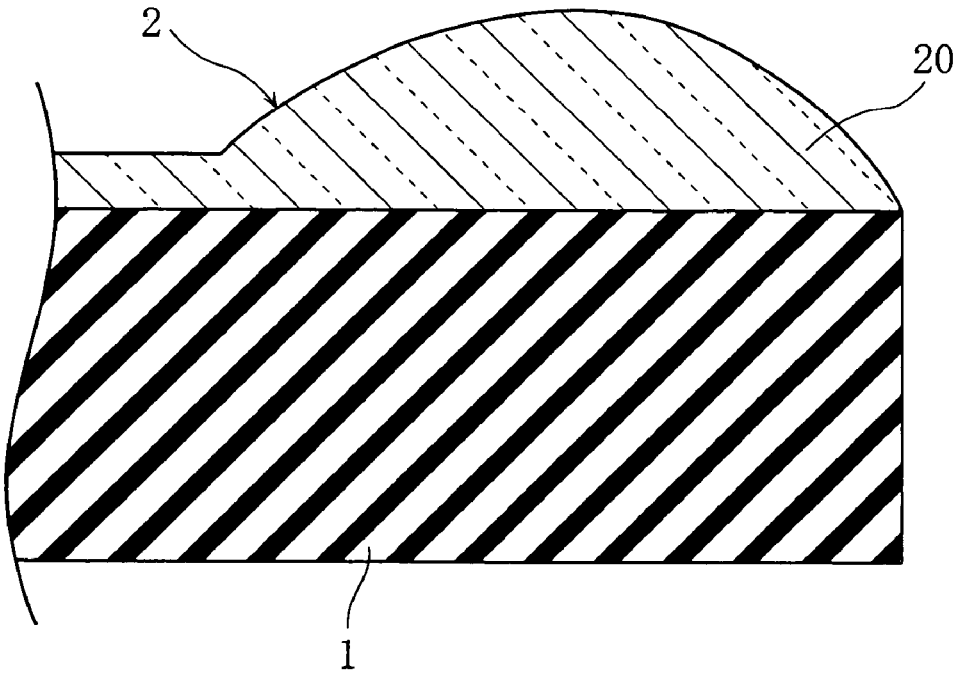
FIG. 4 is a sectional view taken along lines IV-IV of FIG. 3.

First, as shown in FIGS. 3 and 4, the substrate 1 is prepared, and the glaze layer 2 is formed on the substrate 1. The glaze layer is formed by printing and baking an amorphous glass paste. An example of the amorphous glass paste includes a glass material with a glass transition point of 680° C. and a softening point of 865° C.

Figure 5:
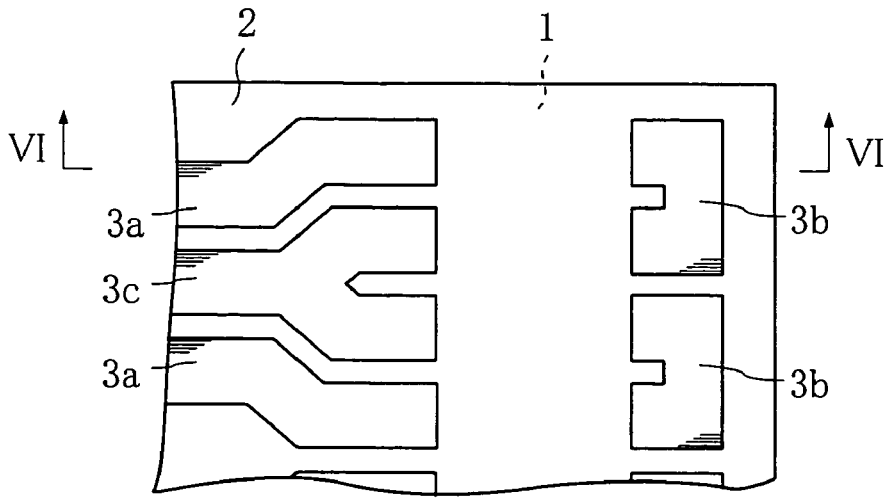
FIG. 5 is a plan view illustrating a step for forming electrodes in the example of manufacturing method of the thermal printhead shown in FIGS. 1 and 2.
Figure 6:
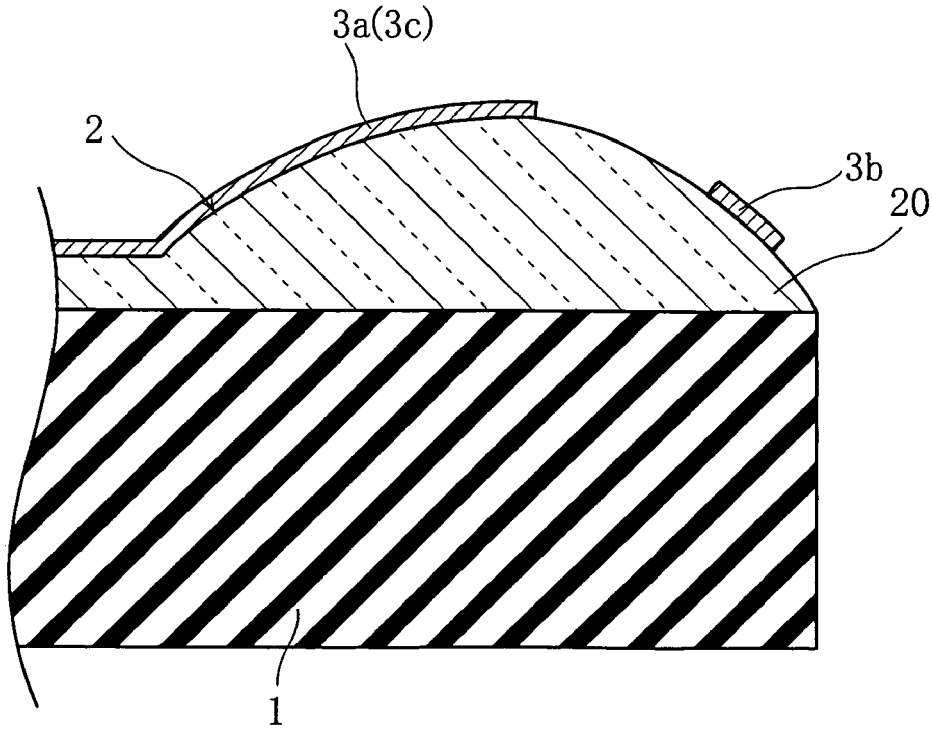
FIG. 6 is a sectional view taken along lines VI-VI of FIG. 5.

Next, as shown in FIGS. 5 and 6, the upper surface of the glaze layer 2 is formed with the electrodes 3*a*-3*c*. The electrodes are formed by printing and baking gold resinate paste and then by performing patterning.

Figure 7:
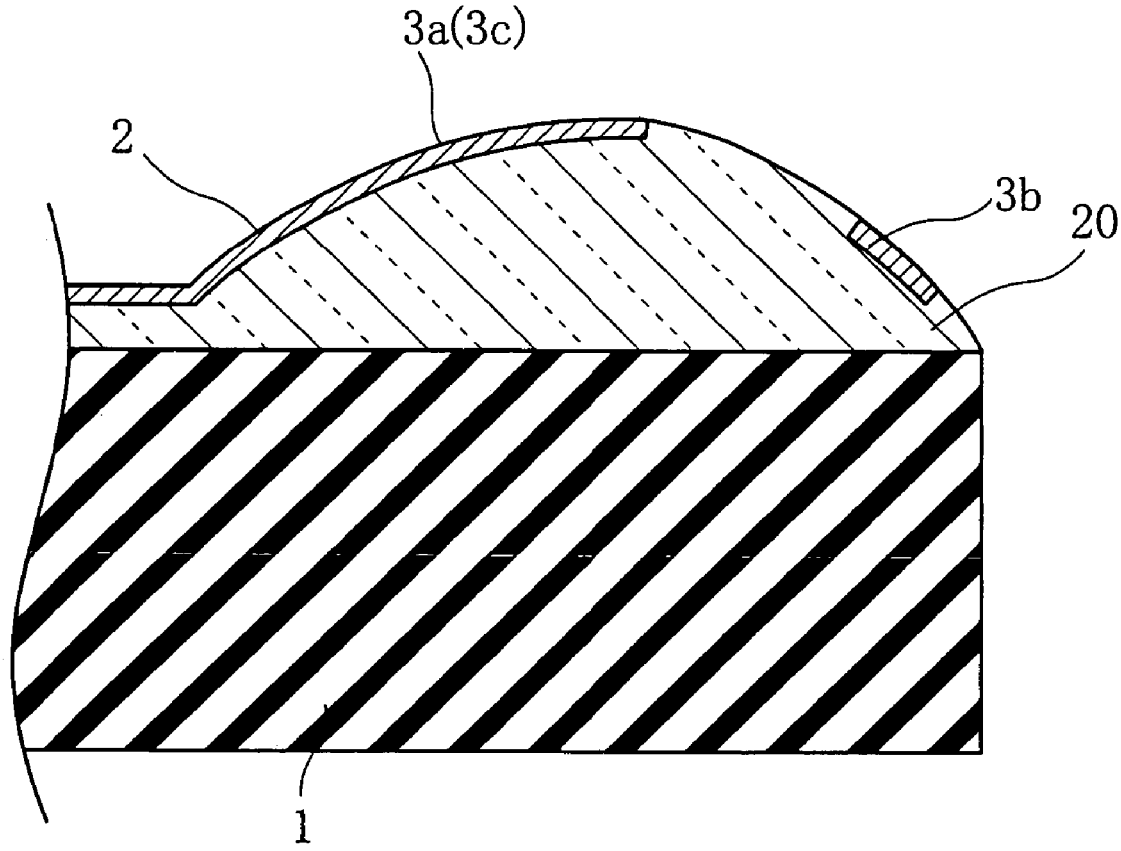
FIG. 7 is a sectional view illustrating a step for embedding electrodes in the example of manufacturing method of the thermal printhead shown in FIGS. 1 and 2.

After forming the electrodes 3*a*-3*c*, as shown in FIG. 7, the electrodes 3*a*-3*c* are caused to sink into the glaze layer 2. In this step, the temperature of the glaze layer 2 is heated in a range of the glass transition point to the glass softening point of the glass material, so that the glaze layer 2 is softened. When the glaze layer 2 is softened, the electrodes 3*a*-3*c* sink, under their own weight, into the glaze layer 2. The depth of this sinking is controllable by adjusting the temperature and time of heating. Specifically, the softening of the glaze layer 2 is finished on or right before the moment when the surfaces of the electrodes 3*a*-3*c* come to be flush with the surface of the glaze layer 2.

Figure 8:
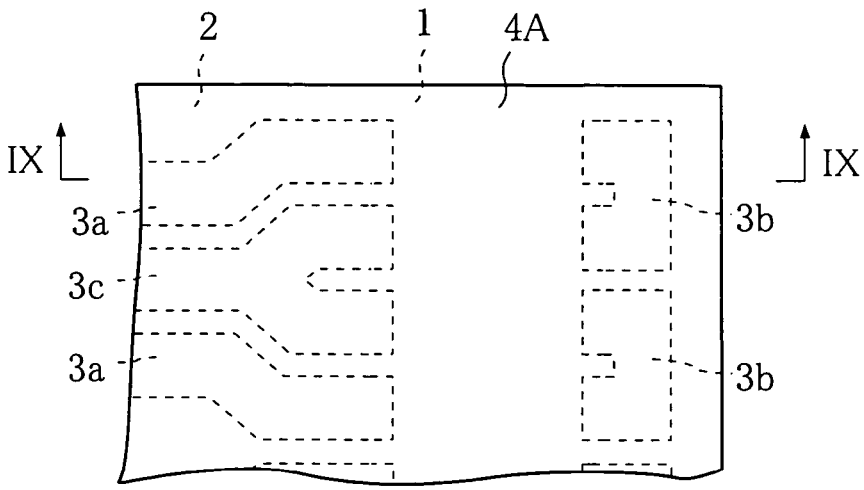
FIG. 8 is a plan view illustrating a step for forming a resistive film in the example of manufacturing method of the thermal printhead shown in FIGS. 1 and 2.
Figure 9:
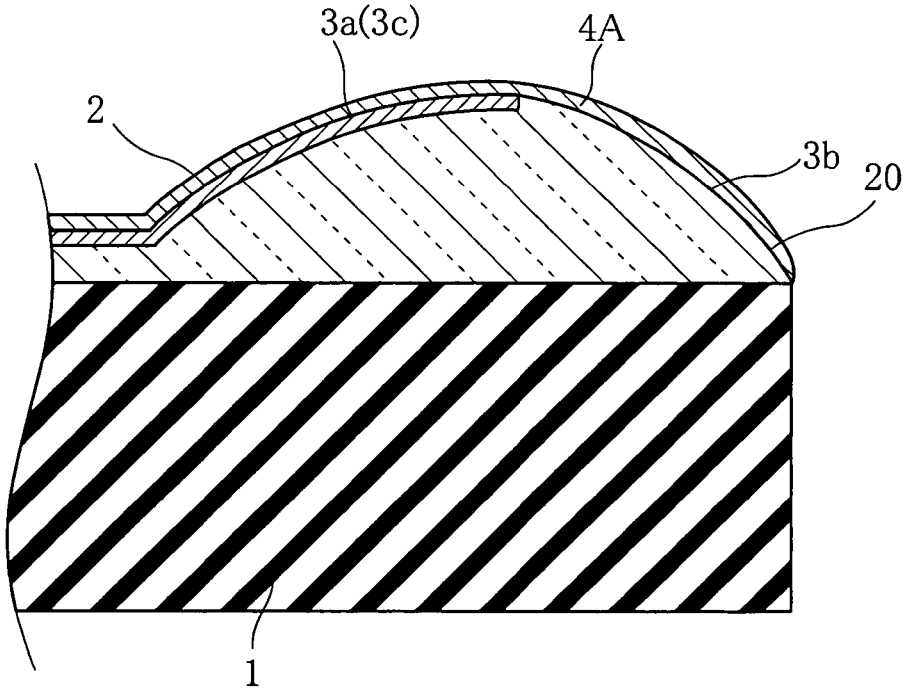
FIG. 9 is a sectional view taken along lines IX-IX in FIG. 8.
Figure 10:
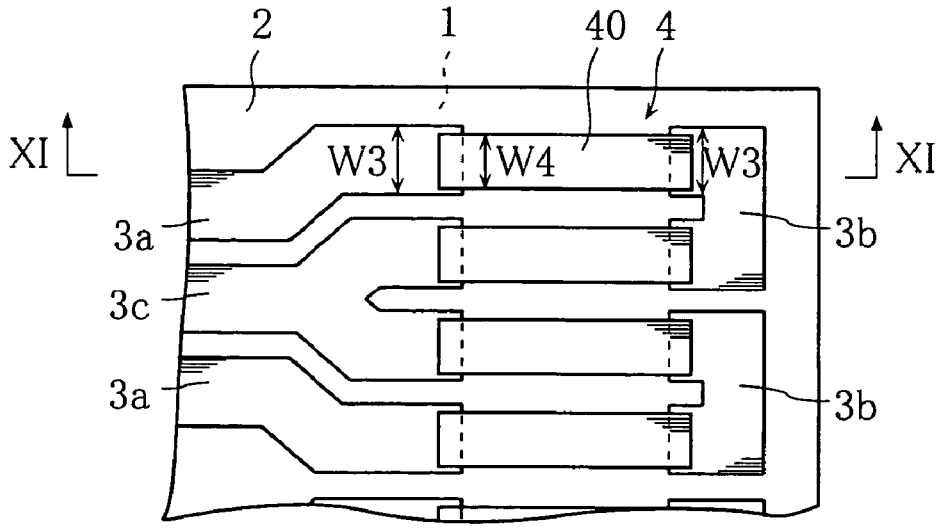
FIG. 10 is a plan view illustrating a step for forming resistors in the example of manufacturing method of the thermal printhead shown in FIGS. 1 and 2.
Figure 11:
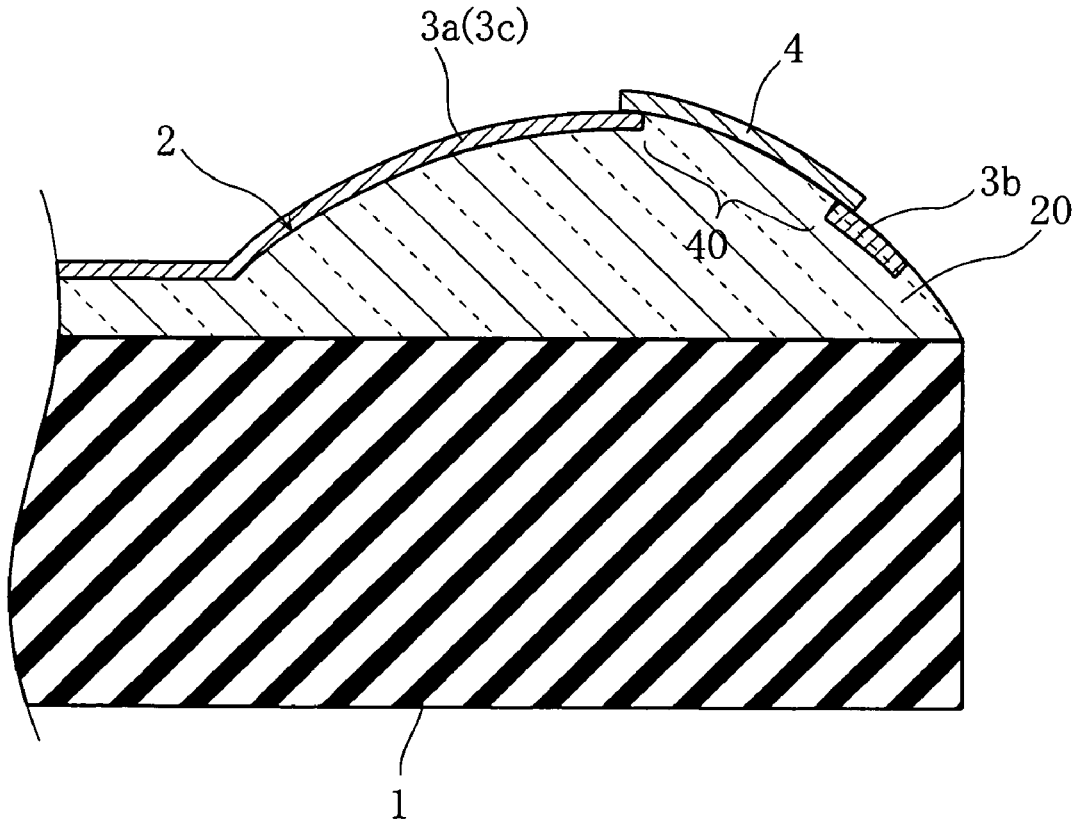
FIG. 11 is a sectional view taken along lines XI-XI in FIG. 10.

After the electrodes 3*a*-3*c* are sunk, the resistors 4 are formed. In forming the resistors 4, as shown in FIGS. 8 and 9, a resistor film 4A is formed to cover the electrodes 3*a*-3*c*. The resistor film 4A is made of $TaSiO_2$, for example, and may be a thick film or a thin film. Next, by performing dry etching at the resistor film 4A, and as shown in FIGS. 10 and 11, a plurality of resistors 4 are formed to bridge between the ends of the electrodes 3*b* and the ends of the electrodes 3*a*, 3*c*. Here, the width W4 is formed to be smaller than the width W3 of the electrodes 3*a*-3*c* at portions overlapping with the resistors 4.

Finally, the protection layer 5 is formed to cover the electrodes 3*a*-3*c* and the resistors 4 by performing thick-film printing and baking glass paste. Alternatively, sputtering with $SiO_2$, SiAlON may be performed to form the protection layer 5. Through these steps, the thermal printhead A1 shown in FIGS. 1 and 2 is made.

In the manufacturing method of the thermal printhead A1 according to the present embodiment, for sinking the electrodes 3*a*-3*c* into the glaze layer 2, the glaze layer 2 is softened, so that the electrodes 3*a*-3*c* sink under their own weight. This method is easier than the method in which the glaze layer 2 is partly cut to form the electrodes 3*a*-3*c* therein. By controlling the temperature and time for heating the glaze layer 2, sinking depth of the electrodes 3*a*-3*c* into the glaze layer 2 can be adjusted. In addition, improper gap can be prevented from being formed between the glaze layer 2 and the electrodes 3*a*-3*c*.

In the above-described manufacturing method, gold is used as a material of electrodes 3*a*-3*c*. Gold has relatively high melting point, and has corrosion resistance higher than that of e.g. aluminum. Further, specific gravity of gold is greater than that of material of the glaze layer. Therefore, in softening the glaze layer 2 by heating, the electrodes are prevented from oxidation and quickly sink into the glaze layer 2 under gravity.

Further, by forming the resistors 4 in dry etching, the resistors 4 can be accurately formed in a predetermined size. Thus, in forming the resistors 4 with the width W4 smaller than the width W3 of the electrodes 3*a*-3*c* at portions overlapping with the resistors 4, the difference between these widths need not to be excessively large. Specifically, in the step for embedding the electrodes 3*a*-3*c*, widthwise deviation may occur while the electrodes 3*a*-3*c* sink into the glaze layer. Here, the difference between the widths W3, W4 may be the same as or measurably larger than the deviation. In this way, printing dots can be properly prevented from having variation in size due to such deviation.

FIGS. 12-29 illustrate other examples of the thermal printhead and manufacturing method according to the present invention. In the figures, elements identical or similar to those in the above first embodiment are indicated by the same reference numbers and duplicated description will be omitted.

Figure 12:
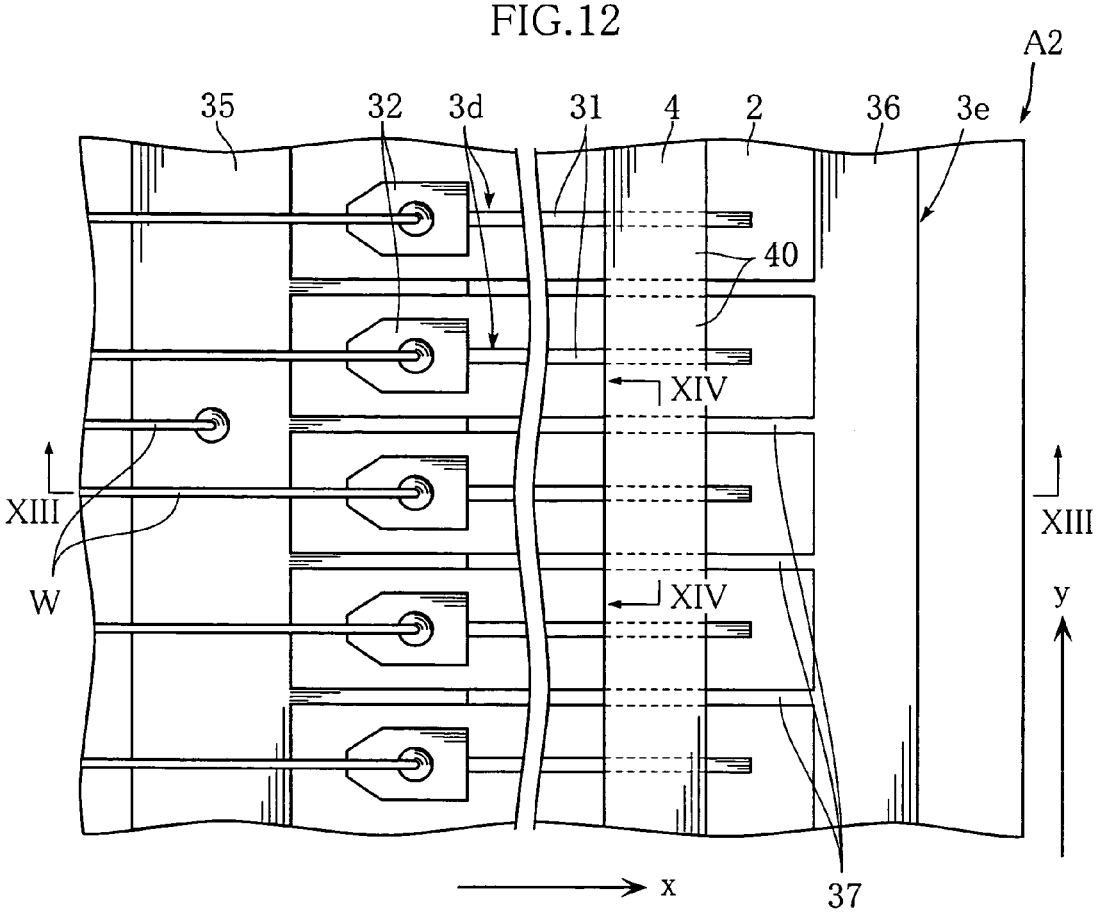
FIG. 12 is a plan view illustrating a thermal printhead according to a second embodiment of the present invention.
Figure 13:
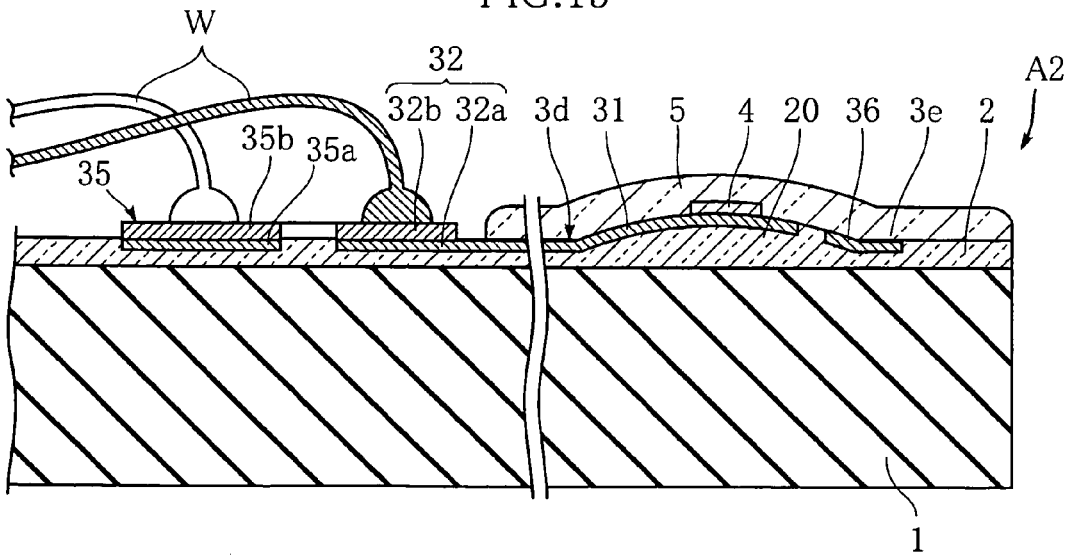
FIG. 13 is a sectional view taken along lines XIII-XIII of FIG. 12.
Figure 14:
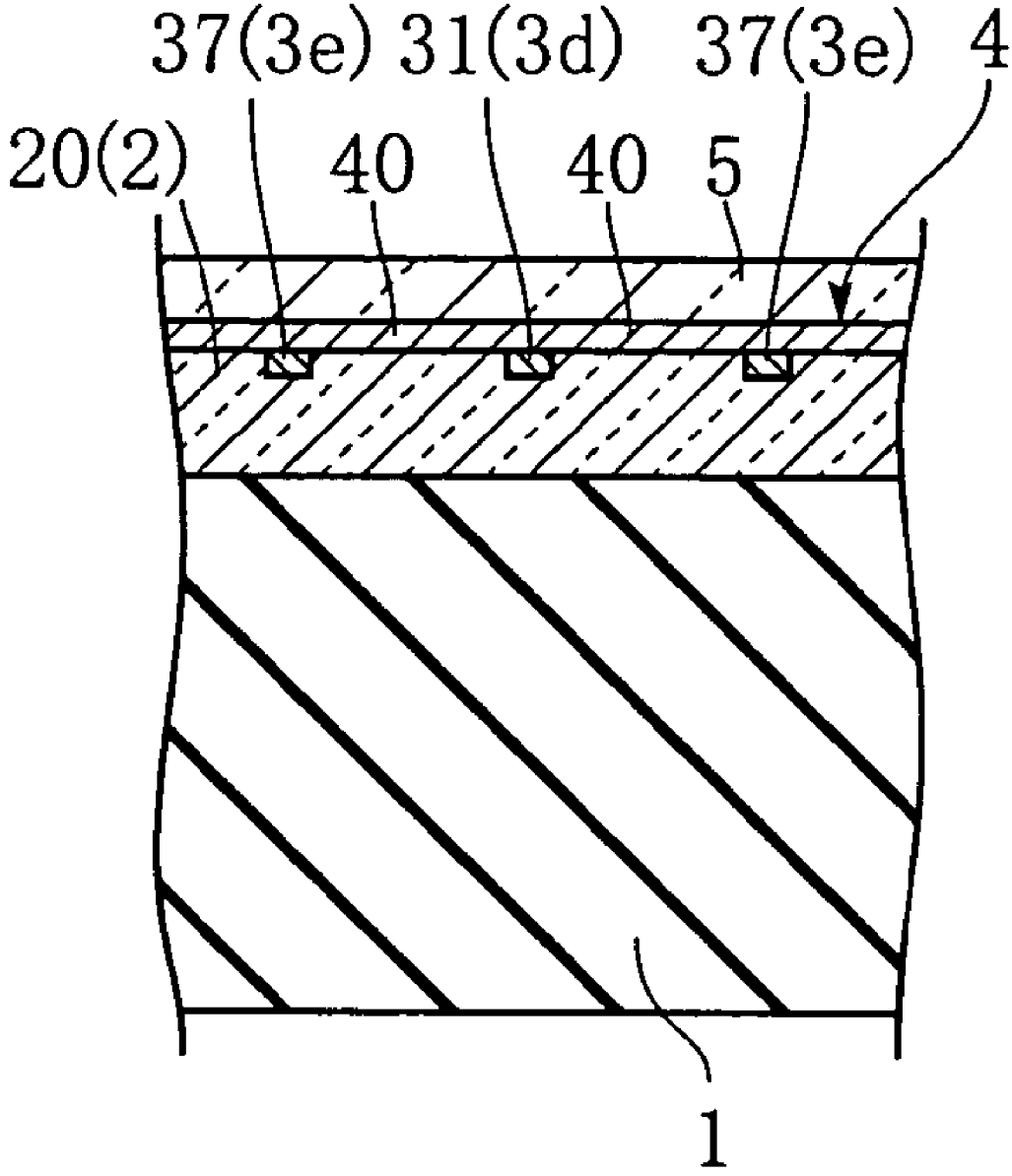
FIG. 14 is a sectional view taken along lines XIV-XIV of FIG. 12.

FIGS. 12-14 illustrate a thermal printhead according to a second embodiment of the present invention. The thermal printhead A2 of the present embodiment differs from the above first embodiment in arrangement of the electrodes and in the form of the resistor 4. The protection layer 5 is omitted in FIG. 12.

As shown in FIG. 12, a plurality of individual electrodes 3*d* are aligned in the primary scanning direction y. Each of the individual electrodes 3*d* includes a narrow portion 31 and a bonding pad 32.

The narrow portion 31 is elongated in the secondary scanning direction x and lies between the resistor 4 and the glaze layer 2. The bonding pad 32 is a portion for bonding a wire W, and includes a first portion 32*a* and an second portion 32*b*. The first portion 32*a* connected to the narrow portion 31 is made by printing and baking gold resinate paste. Each of the narrow portion 31 and the first portion 32*a* has a thickness of 0.6 μm and an upper surface substantially flush with the glaze layer 2. The second portion 32*b* protrudes upwardly from the glaze layer 2, and the wire W is directly bonded thereto.

The second portion 32*b* is made by printing and baking gold paste, and has a thickness of 1 μm. Here, the gold paste is a paste, different from gold resinate paste, in which gold particles are mixed with a binder. A film formed of gold resinate paste has a relatively small thickness which is suitable for forming a smooth surface, while a film formed of the gold paste has a relatively large thickness. In place of printing and baking the gold paste, sputtering of gold may be performed to make the second portion 32*b*.

As shown in FIG. 12, the common electrode 3*e* includes a pair of belt-like portions 35, 36 and a plurality of narrow portions 37. The belt-like portions 35, 36 are elongated in the primary scanning direction y, and spaced from each other in the secondary scanning direction x across the resistor 4. The narrow portions 37 are elongated in the secondary scanning direction x, and are aligned in the primary scanning direction alternately with the individual electrodes 3*d*. The belt-like portions 35, 36 are connected to each other via the narrow portions 37.

The belt-like portion 35 partly serves as a bonding pad for bonding the wire W. As shown in FIG. 13, the belt-like portion 35 includes a first portion 35*a* and a second portion 35*b*. The first portion 35*a* is connected to the narrow portions 37 and to the belt-like portion 36, and is made by printing and baking gold resinate paste. Each of the first portion 35*a*, the narrow portions 37, and the belt-like portion 36 has a thickness of 0.6 μm and an upper surface substantially flush with the glaze layer 2. The second portion 35*b* is made, similarly to the second portions 32, by printing and baking gold paste, and has a thickness of 1 μm.

The resistor 4 is, as shown in FIG. 12, formed in a strip elongated in the primary scanning direction y, and as shown in FIG. 13, arranged above the projection 20 of the glaze layer 2. As shown in FIGS. 12 and 14, the resistor 4 is laminated on the narrow portions 31 of the individual electrodes 3*d* and the narrow portions 37 of the common electrode 3*e*. The resistor 4 serves as the heating portions 40 at portions between the narrow portions 31 and the narrow portions 37. As shown in FIG. 14, the narrow portions 31, the narrow portions 37, and the glaze layer 2 are flush with each other, so that the resistor 4 has a smooth surface extending in the primary scanning direction y, with little difference in level.

In printing by the thermal printhead A2, non-illustrated drive ICs select one of the individual electrodes 3*d*. Here, an electrical current flows between the selected individual electrodes 3*d* and the narrow portions 37, thereby generating heat at the heating portions 40. The heat is transmitted to a thermal recording medium for performing printing thereon.

Next, the function of the thermal printhead A2 is described below.

In the present embodiment, as shown in FIG. 14, as the resistor 4 has a smooth surface extending in the primary scanning direction y, a portion of the protection layer 5 covering the resistor 4 also has a smooth surface extending in the primary scanning direction y. Thus, the portion of the protection layer 5 covering the resistor 4 is suitable for sticking to the thermal recording medium. Even if the thermal recording medium is made of a relatively hard material such as plastic, the protection layer 5 can properly stick to the thermal recording medium. This facilitates the heat transmission from the heating portions 40 of the resistor 4 to the thermal recording medium. Therefore, the thermal printhead A2 is able to perform clear printing. The thermal printhead is especially suitable to be used in a high-definition printer, for performing clear printing at downsized printing dots.

Energizing of the heating portion 40 is performed through the belt-like portions 35, 36. The total area of the belt-like portions 35, 36 is relatively large, which prevents voltage reduction at the belt-like portions 35, 36. The width of the belt-like portion 36 can be relatively small. When the belt-like portion 36 has a small width, the resistor 4 can be arranged close to the right end of the substrate 1. In this way, the thermal printhead A2 can be designed as so-called near-edge type, in which the resistor 4 is arranged in the vicinity of the right end of the substrate 1.

Each of the bonding pads 32 and the belt-like portion 35, to which the wire W is bonded, protrudes from the glaze layer 2. Thus, even if a tip of a bonding tool for bonding the wire W is larger than e.g. the bonding pad 32, the bonding tool is prevented from unduly contacting the glaze layer 2. Therefore, the wire W can be properly bonded. Each of the bonding pads 32 and the belt-like portion 35 has a relatively large thickness of about 1.6 μm. Therefore, bonding strength of the wire W can be increased.

Next, an example of manufacture method of the thermal printhead A2 is described below with reference to FIGS. 15-23. FIGS. 15-23 are plan views and sectional views illustrating a series of steps in the manufacturing method of the thermal printhead A2 according to the present embodiment.

Figure 15:
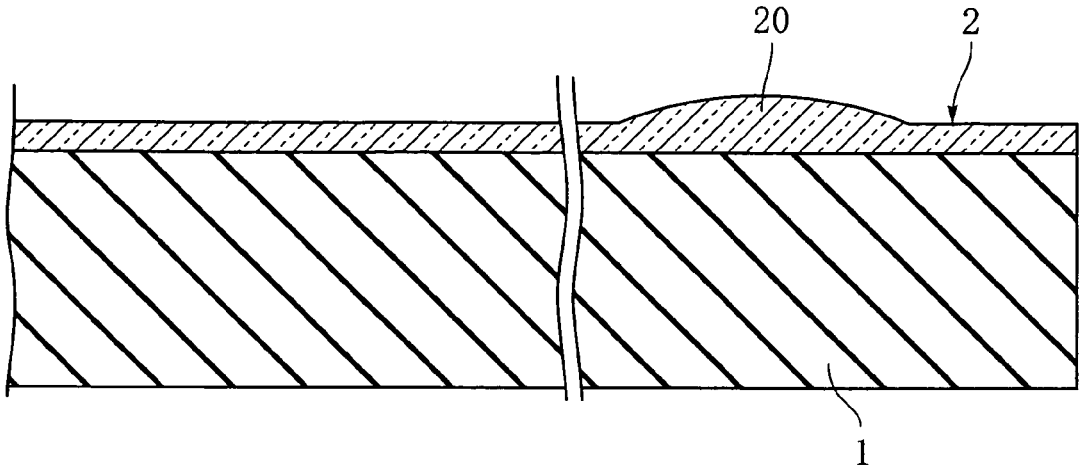
FIG. 15 is a sectional view illustrating a step for forming a glaze layer in an example of manufacturing method of the thermal printhead shown in FIGS. 12-14.

First, as shown in FIG. 15, the substrate 1 is prepared, and the glaze layer 2 is formed on the substrate 1. The glaze layer 2 is formed by performing thick-film printing and baking, using an amorphous glass paste.

Figure 16:
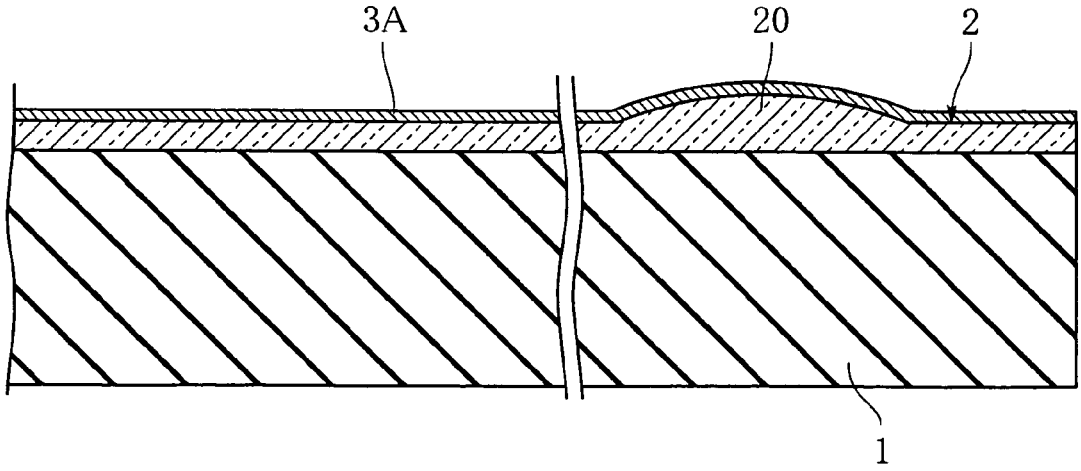
FIG. 16 is a sectional view illustrating a step for forming a gold thin layer in the example of manufacturing method of the thermal printhead shown in FIGS. 12-14.

Next, as shown in FIG. 16, a thin gold layer 3A is formed. The thin gold layer 3A is formed by printing and baking gold resinate paste. Here, the thickness of the thin gold layer 3A is about 0.6 μm.

Figure 17:
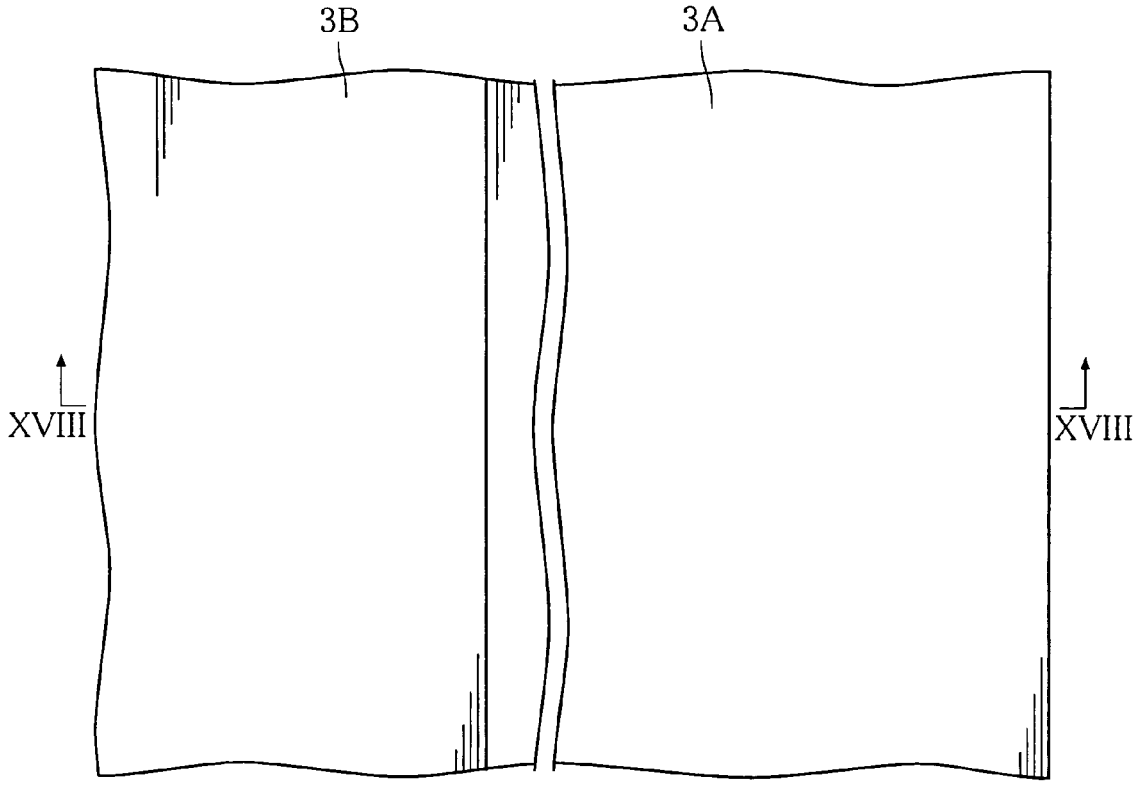
FIG. 17 is a plan view illustrating a step for forming another gold thin layer in the example of manufacturing method of the thermal printhead shown in FIGS. 12-14.
Figure 18:
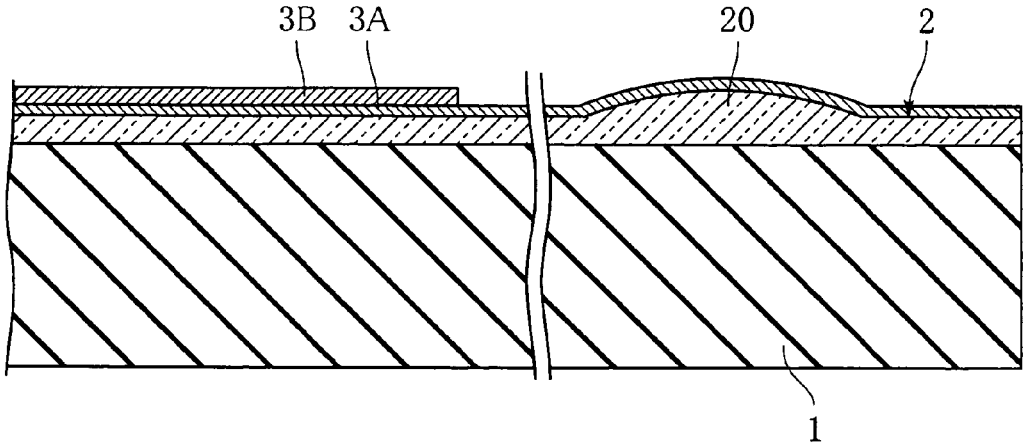
FIG. 18 is a sectional view taken along lines XVIII-XVIII of FIG. 17.

Subsequently, as shown in FIGS. 17 and 18, a thin gold layer 3B is formed on the thin gold layer 3A. Here, the thickness of the thin gold layer 3B is about 1 μm. The right side portion of the thin gold layer 3A is exposed from the thing old layer 3B. The thing old layer 3B is formed by printing and baking gold paste. Differently from the present embodiment, the thin gold layer 3B may be formed, by repeating the printing and baking of gold resinate paste. The thin gold layer 3B may also be formed by sputtering gold.

Figure 19:
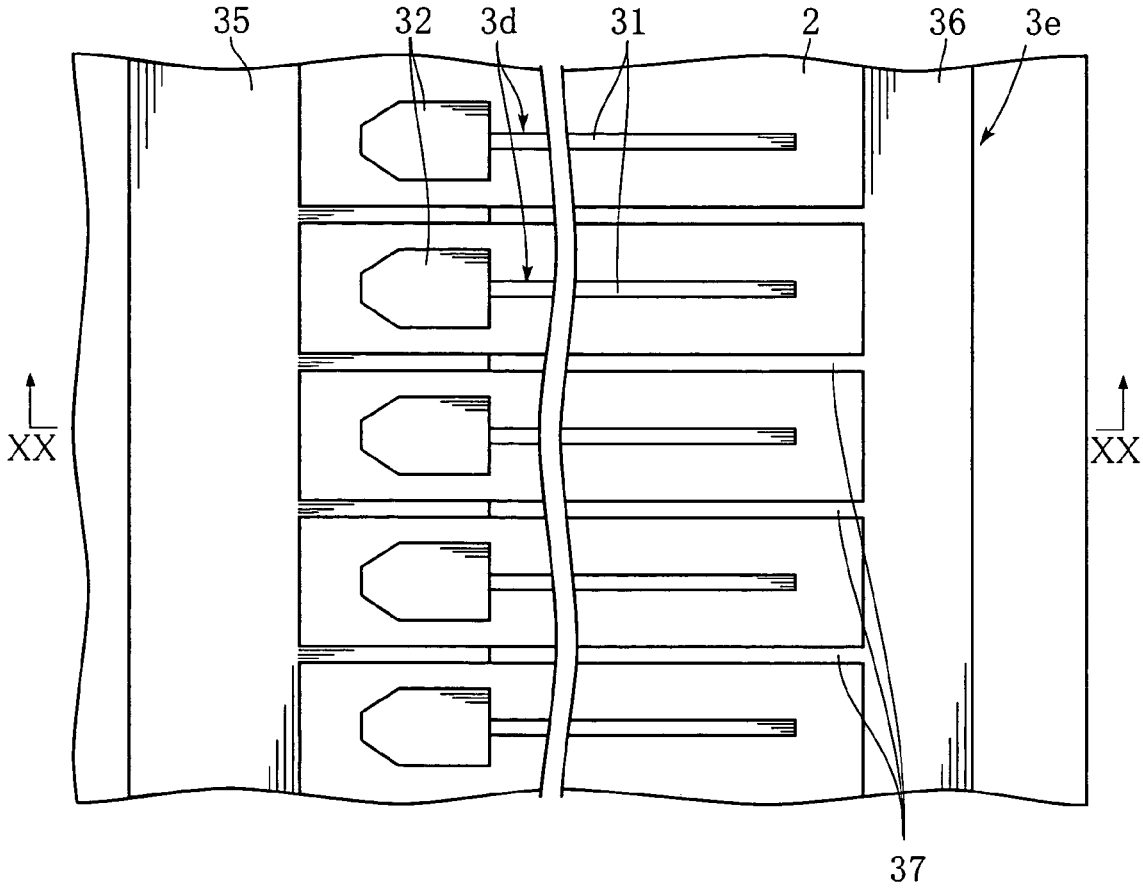
FIG. 19 is a plan view illustrating a step for forming electrodes in the example of manufacturing method of the thermal printhead shown in FIGS. 12-14.
Figure 20:
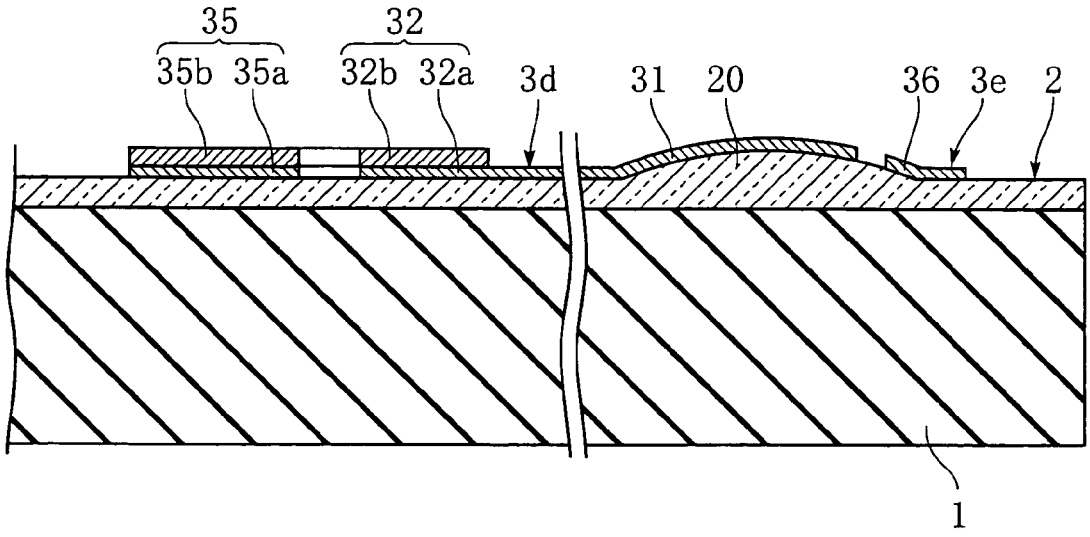
FIG. 20 is a sectional view taken along lines XX-XX of FIG. 19.

After forming the gold thin layers 3A, 3B, patterning is performed at the gold thin layers 3A, 3B, so that the individual electrodes 3*d* and the common electrode 3*e* are formed as shown in FIGS. 19 and 20. The patterning is performed by wet etching, for example.

Figure 21:
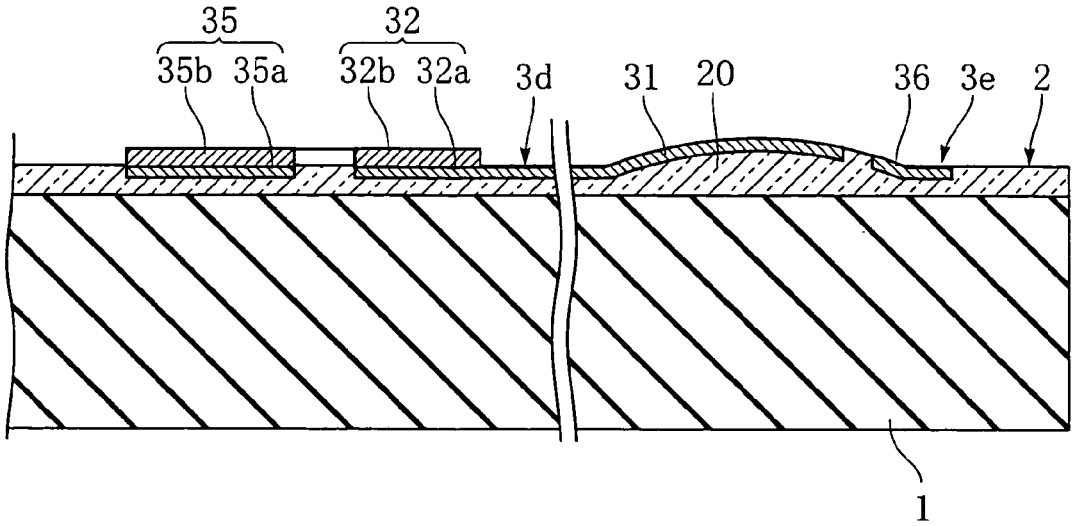
FIG. 21 is a sectional view illustrating a step for embedding the electrodes in the example of manufacturing method of the thermal printhead shown in FIGS. 12-14.

Next, as shown in FIG. 21, the individual electrodes 3*d* and the common electrode 3*e* are caused to sink into the glaze layer 2. This step for sinking the electrodes is performed similarly to the method described with reference to FIG. 7. In this step, the upper surfaces of the narrow portions 31, the narrow portions 37, and the belt-like portion 36 are arranged to be flush with the surface of the glaze layer 2. The second portions 32*b*, 35*b* of the bonding pads 32 and the belt-like portion 35 protrude from the glaze layer 2.

Figure 22:
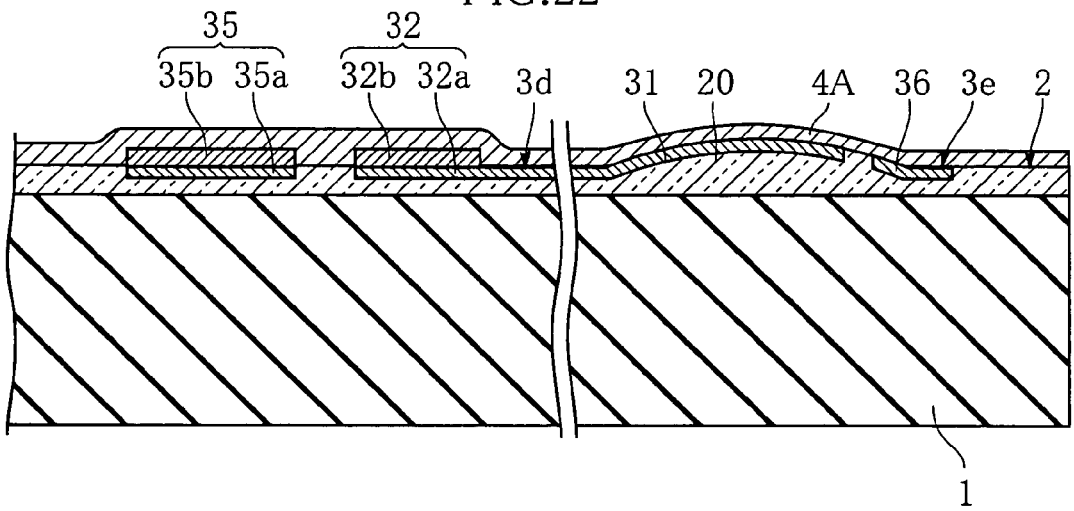
FIG. 22 is a sectional view illustrating a step for forming a resistive film in the example of manufacturing method of the thermal printhead shown in FIGS. 12-14.
Figure 23:
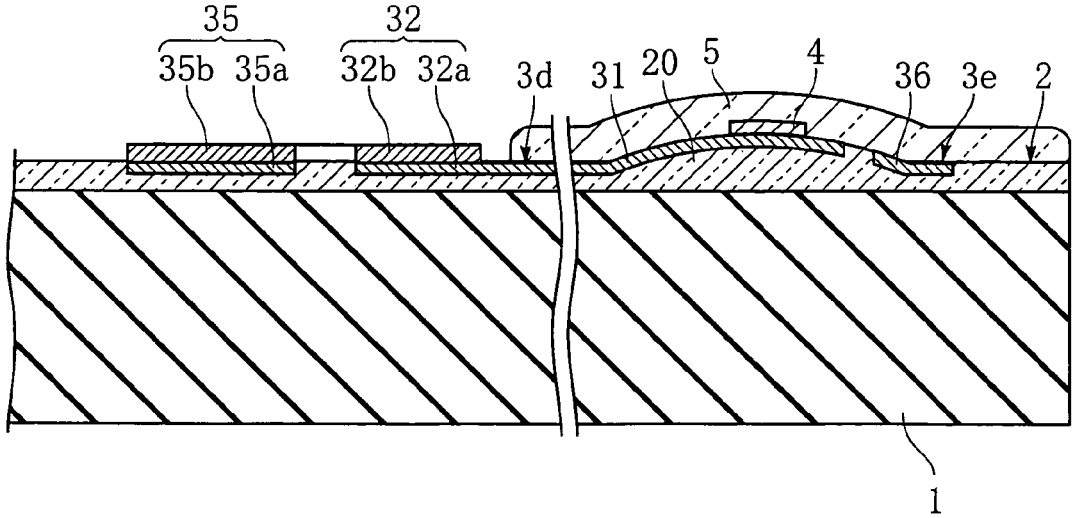
FIG. 23 is a sectional view illustrating a step for forming a resistor and a protection layer in the example of manufacturing method of the thermal printhead shown in FIGS. 12-14.

After the electrodes are sunk, as shown in FIG. 22, a resistor film 4A is formed. Then, patterning is performed at the resistor film 4A to form the resistor 4, as shown in FIG. 23. Subsequently, the protection layer 5 is formed to cover the resistor 4, the belt-like portion 36, a part of each of the narrow portions 31, and a part of each of the narrow portions 37. After performing other steps such as bonding the wire W at each of the bonding pads 32 and the belt-like portion 35, the thermal printhead A2 shown in FIGS. 12-14 is obtained.

According to the manufacturing method, only the bonding pads 32 and the belt-like portion 35 of the individual electrodes 3*d* and the common electrode 3*e* protrude from the glaze layer 2 by a desired height. This facilitates bonding of the wire W.

Figure 24:
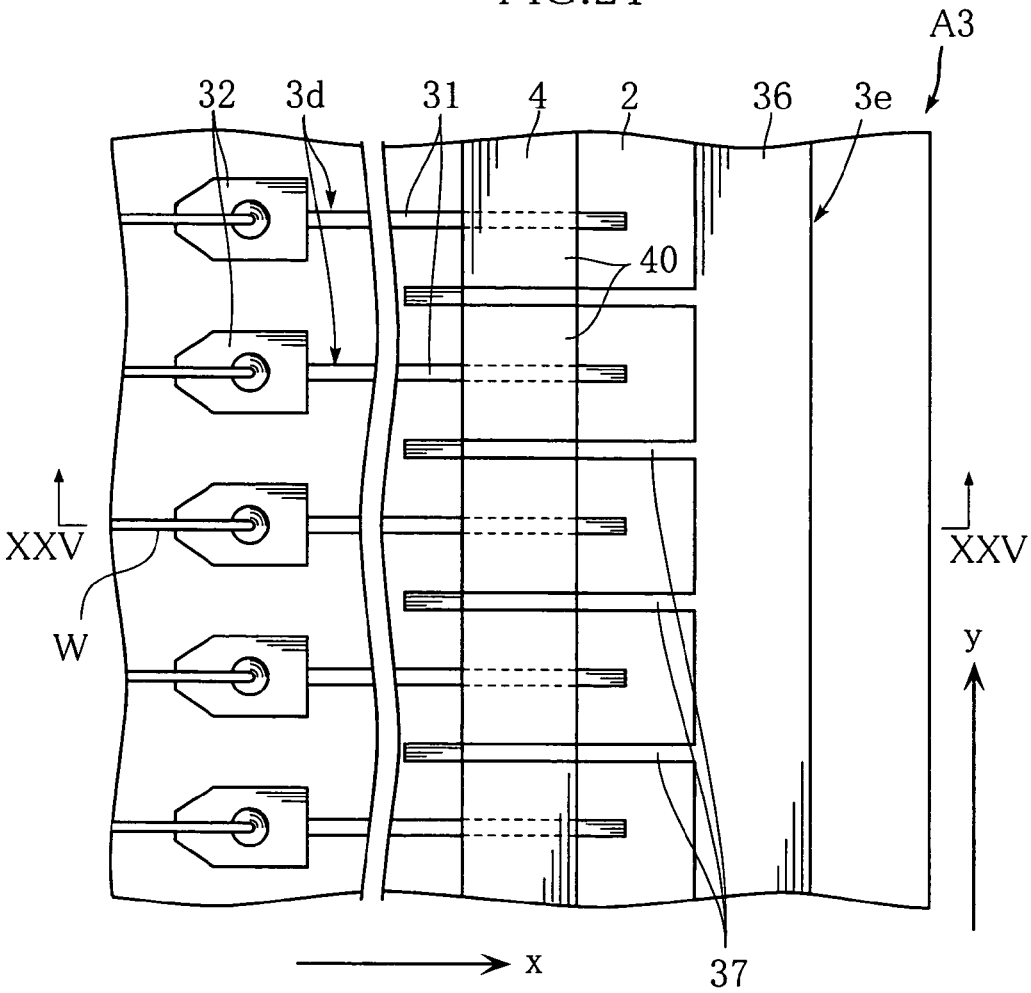
FIG. 24 is a plan view illustrating a thermal printhead according to a third embodiment of the present invention.
Figure 25:
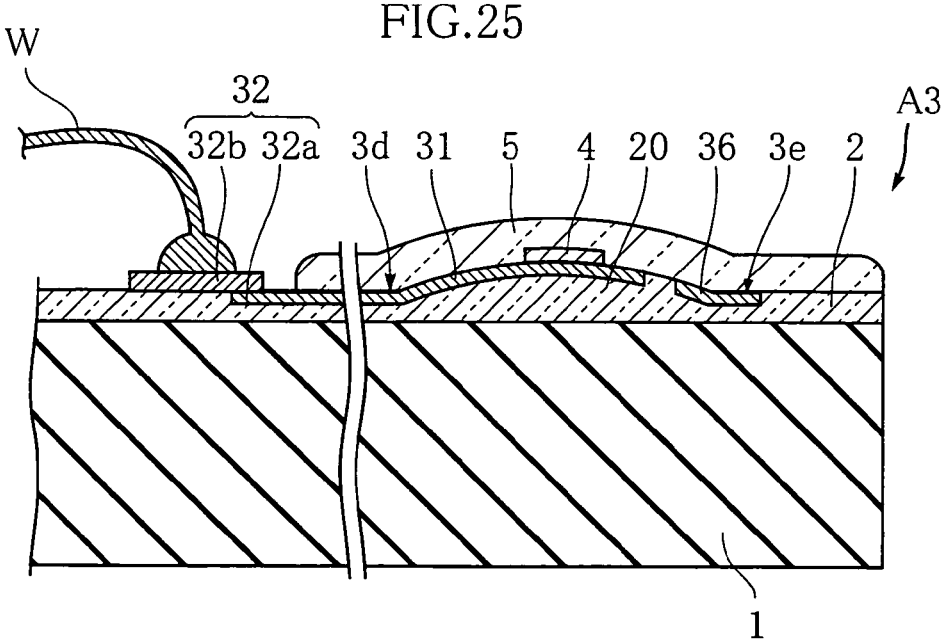
FIG. 25 is a sectional view taken along lines XXV-XXV of FIG. 24.
Figure 26:
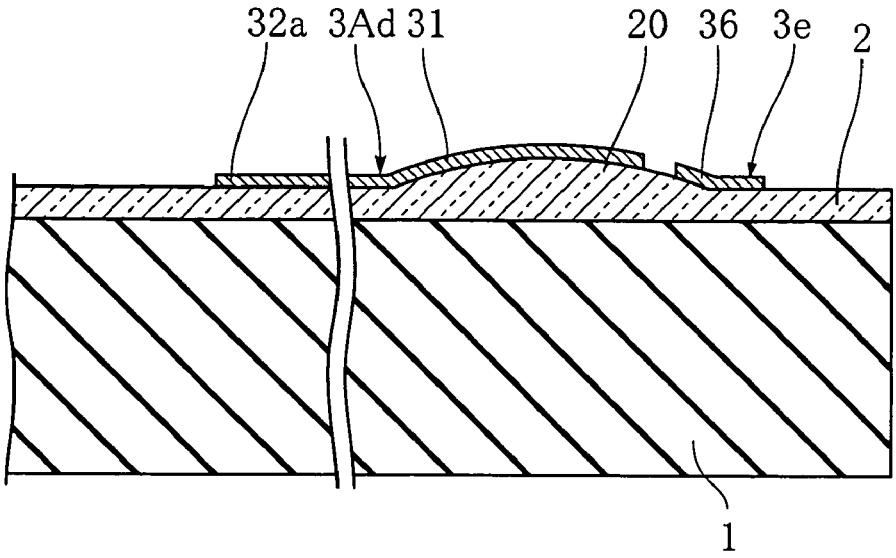
FIG. 26 is a sectional view illustrating a step for forming an electrode in an example of manufacturing method of the thermal printhead shown in FIGS. 24 and 25.

FIGS. 24 and 25 illustrate a thermal printhead according a third embodiment of the present invention. The thermal printhead A3 differs from the second embodiment in structure of the bonding pads 32 and in form of the common electrode 3*e*. The protection layer 5 is omitted in FIG. 24.

As shown in FIG. 25, each of the bonding pads 32 includes a first portion 32*a* partly overlapping with a second portion 32*b*. The bonding pad is identical to the second embodiment in that the first portion 32*a* has an upper surface flush with the surface of the glaze layer 2, and the second portion 32*b* protrudes out of the glaze layer 2. The common electrode 3*e* includes one belt-like portion 36.

With such structure, the wire W can be properly bonded, and the bonding strength between the wire W and the bonding pad 32 can be increased. Further, as the area of the first portion 32*a* is reduced, gold material can be saved.

Next, an example of manufacturing method of the thermal printhead A3 is described with reference to FIGS. 26-29. FIGS. 26-29 are sectional views illustrating a series of steps in the manufacturing method of the thermal printhead A3 according to the present embodiment.

In the manufacturing method of the present embodiment, as already described with reference to FIG. 16, the substrate 1 is first formed with a glaze layer 2 and a gold thin layer 3A. Then, patterning is performed at the gold thin layer 3A to form electrodes 3Ad and a common electrode 3*e*.

Figure 27:
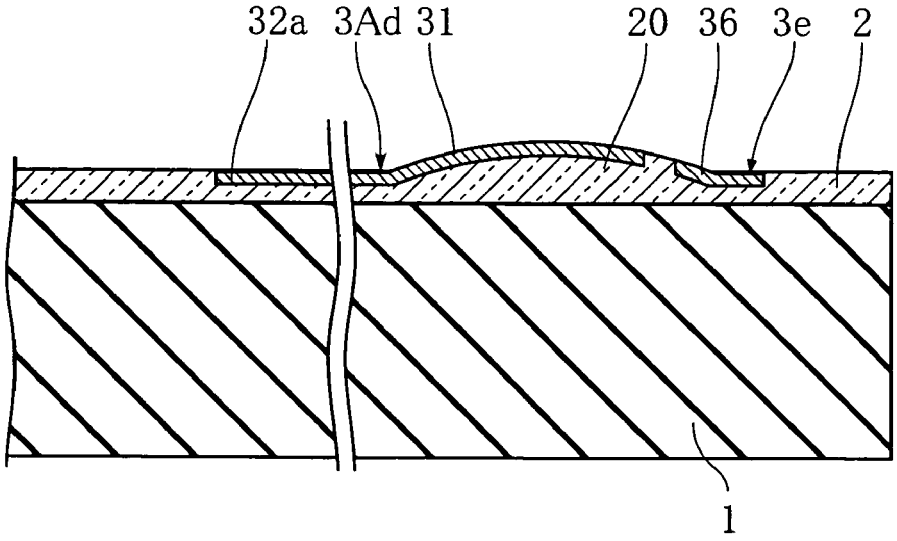
FIG. 27 is a sectional view illustrating a step for embedding the electrode in the example of manufacturing method of the thermal printhead shown in FIGS. 24 and 25.
Figure 28:
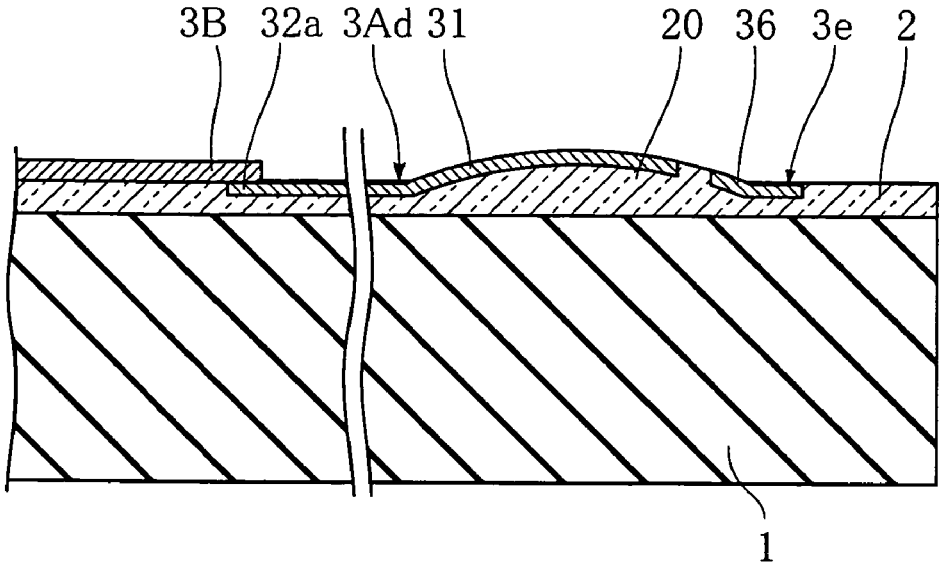
FIG. 28 is a sectional view illustrating a step for forming a gold thin layer in the example of manufacturing method of the thermal printhead shown in FIGS. 24 and 25.
Figure 29:
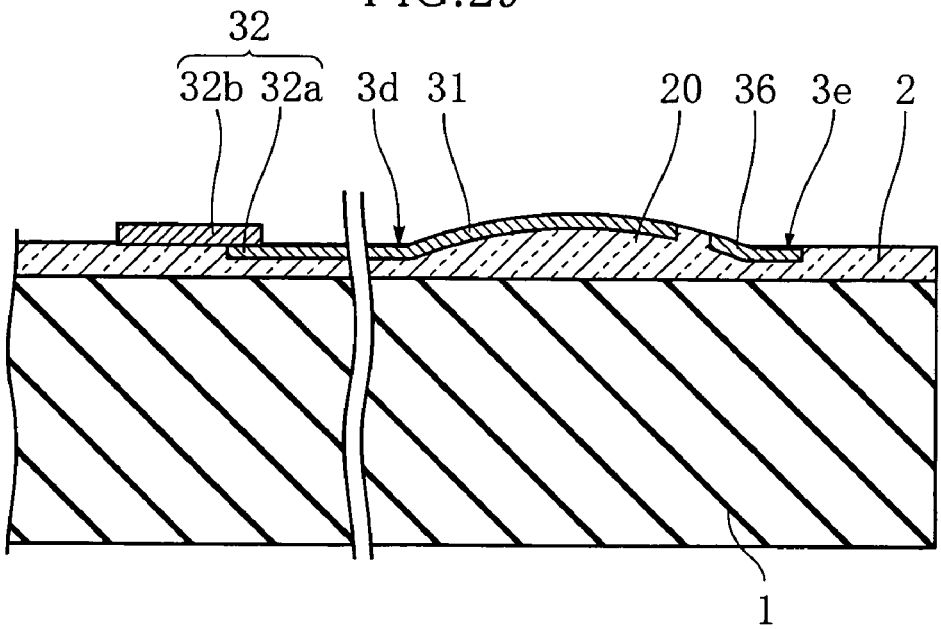
FIG. 29 is a sectional view illustrating a step for forming another electrode in the example of manufacturing method of the thermal printhead shown in FIGS. 24 and 25.

Next, as shown in FIG. 27, the electrodes 3Ad and the common electrode 3*e* are caused to sink into the glaze layer 2. By sinking the electrodes 3Ad, the upper surfaces of the electrodes 3Ad come to be flush with the surface of the glaze layer 2. Then, as shown in FIG. 28, a gold thin layer 3B is formed. The gold thin layer 3B is formed by printing and baking gold paste. Here, the gold thin layer 3B has a thickness of about 1 μm. The gold thin layer 3B partly overlaps with the first portions 32*a* at its right side end. Then, patterning is performed at the gold thin layer 3B to form the second portions 32*b* shown in FIG. 29. In this way, the individual electrodes 3*d* are made. Thereafter, the same steps as the second embodiment are performed to obtain the thermal printhead A3.

In the manufacturing method, the step for sinking the electrodes is performed before forming the second portions 32*b* on the first portions 32*a* and the glaze layer 2. Thus, the bonding pads 32 can reliably protrude out of the glaze layer 2 by the thickness of the gold-thin layer 3B or the second portions 32*b*. This is suitable to perform the wire bonding properly.

The present invention being thus described, though not limited to this, and may be variously modified within the scope of the present invention.

In the first embodiment, the electrodes 3*a*-3*c* are arranged to sink into the glaze layer so that the electrodes 3*a*-3*c* come to be substantially flush with the glaze layer 2, though not limited to this. For example, the electrodes 3*a*-3*c* may be partly embedded in the glaze layer 2 at their bottom portions, and the other portions may protrude above the glaze layer 2. Even with such structure, the difference in level between the electrodes 3*a*-3*c* and the glaze layer 2 can be reduced, thereby obtaining an effect in comparison with the conventional arrangement.

Further, in the first embodiment, whole of the electrodes 3*a*-3*c* are arranged to be embedded in the glaze layer 2, though not limited to this. It suffices if each of the electrodes 3*a*-3*c* is sunk at least at a portion laminated with the resistor 4.

The method for sinking the electrodes 3*a*-3*c* into the glaze layer 2 is not limited to the present embodiments, but a portion of the glaze layer to be formed with the electrodes may be curved to form recesses, corresponding to the thickness of the electrodes, and the electrodes may formed in the recess by thick-film printing.

In the manufacturing method according to the second embodiment, the gold thin layers 3A, 3B are laminated to each other, however, the gold thin layer 3A may be formed to have a thickness of about 1.6 μm, and etching may be performed at the thin layer 3A several times, so that the thickness of the bonding pad 32 is larger than the other portion of the individual electrode 3*d*. Similar method may be utilized to form the common electrode 3*e*.

The invention claimed is:

1. A thermal printhead comprising:

a substrate;

a glaze layer formed on the substrate and including a raised portion;

electrodes formed on the raised portion of the glaze layer, the electrodes being spaced from each other; and a resistor laminated on the electrodes and the raised portion of the glaze layer, the resistor bridging the electrodes;

wherein the electrodes are embedded in the raised portion of the glaze layer at least at portions laminated with the resistor.

2. The thermal printhead according to claim 1, wherein the electrodes are sunk to a depth causing surfaccs of the electrodes to be flush with a surface of the raised portion of the glaze layer at portions laminated with the resistor.

3. The thermal printhead according to claim 1, further comprising a protection layer for covering the electrodes and the resistor.

4. The thermal printhead according to claim 1, wherein each of the electrodes has a melting point higher than a softening point of the glaze layer, and is made of a metal having a specific gravity greater than that of the glaze layer.

5. The thermal printhead according to claim 1, wherein the resistor has a width smaller than a width of the electrodes at portions overlapping with the resistors.

6. The thermal printhead according to claim 1, wherein:

the resistor is formed into a strip elongated in a primary scanning direction;

the electrodes include a plurality of individual electrodes and at least one common electrode;

the common electrode includes at least one belt-like portion spaced from the resistor in a secondary scanning direction and extending in the primary scanning direction, and also includes a plurality of narrow portions extending from the belt-like portion in the secondary scanning direction across the resistor and being aligned in the secondary scanning direction; and each of the individual electrodes includes a narrow portion extending in the secondary scanning direction across the resistor, and is aligned in the primary direction alternately with the narrow portions of the common electrode.

7. The thermal printhead according to claim 6, wherein the common electrode includes a pair of belt-like portions spaced from each other in the secondary scanning direction across the resistor.

8. The thermal printhead according to claim 7, wherein at least one of the narrow portions of the common electrode connect the pair of belt-like portions to each other.

9. The thermal printhead according to claim 1, wherein:

each of the electrodes is formed with a bonding pad for wire bonding; and the bonding pad protrudes out of the glaze layer.

10. The thermal printhead according to claim 9, wherein the bonding pad protrudes out of the glaze layer by 1 μm.

11. The thermal printhead according to claim 9, wherein a portion of the electrode formed with the bonding pad has a thickness larger than other portions of the electrode without the bonding pad.

12. The thermal printhead according to claim 9, wherein the bonding pad includes a first portion flush wit the glaze layer, and a second portion formed on the first portion.

13. A method of manufacturing a thermal printhead, the method comprising the steps of:

forming a glaze layer including a raised portion on a substrate, the glaze layer being made of an amorphous glass material having a glass transition point and a glass softening point higher than the glass transition point;

forming electrodes spaced from each other on the raised portion of the glaze layer; and forming a resistor on the raised portion of the glaze layer and the electrodes, the resistor being arranged to bridge the electrodes;

wherein the method further comprises a step for embedding the electrodes, performed after forming the electrodes and before forming the resistor, in which at least a part of the glaze layer is softened by heating in a range of the glass transition point to the glass softening point, so that at least a part of each of the electrodes is caused to sink into the raised portion of the glaze layer.

14. The manufacturing method of thermal printhead according to claim 13, wherein the step for forming the resistor is performed by forming a resistive film and then by performing dry etching at the film.

15. The manufacturing method of thermal printhead according to claim 13, further comprising a step, performed before the step for sinking the electrodes, for forming a second portion on apart of each of the electrodes.

16. The manufacturing method of thermal printhead according to claim 13, further comprising a step, performed after the step for sinking the electrodes, for forming a second portion at least partly laminated on a part of each of the electrodes.

* * * * *